United States Patent [19]

Watanabe et al.

[11] Patent Number: 4,516,128

[45] Date of Patent: May 7, 1985

[54] BEAM WAVEGUIDE FEEDER

[75] Inventors: Fumio Watanabe; Yoshihiko Mizuguchi; Matsuichi Yamada, all of Tokyo, Japan

[73] Assignee: Kokusai Denshin Denwa Kabushiki Kaisha, Tokyo, Japan

[21] Appl. No.: 457,608

[22] Filed: Jan. 13, 1983

[30] Foreign Application Priority Data

Feb. 15, 1982 [JP] Japan ..... 57-22295

[51] Int. Cl.[3] ..... H01Q 19/18; H01Q 3/12

[52] U.S. Cl. ..... 343/761; 343/781 P

[58] Field of Search ..... 343/761, 781 P, 837, 343/839, 840, 781 CA, 757–759

[56] References Cited

U.S. PATENT DOCUMENTS

| | | | |
|---|---|---|---|
| 3,845,483 | 10/1974 | Soma et al. | 343/761 |
| 3,968,497 | 7/1976 | Bui Hai | 343/761 |
| 4,044,361 | 8/1977 | Yokoi et al. | 343/761 |
| 4,062,018 | 12/1977 | Yokoi et al. | 343/761 |
| 4,186,402 | 1/1980 | Mizusawa et al. | 343/837 |
| 4,260,993 | 4/1981 | Aubry et al. | 343/781 CA |

*Primary Examiner*—Eli Lieberman
*Assistant Examiner*—Michael C. Wimer
*Attorney, Agent, or Firm*—Pollock, Vande Sande and Priddy

[57] ABSTRACT

A beam waveguide feeder in which a feed horn, a pair of revolvable paraboloidal reflectors, and at least one plane reflector are arranged in the order stated so as to form a path for an electric wave, said pair of paraboloidal reflectors facing each other and being equal in focal distance and off-set angle, their zeniths and focuses being on an identical plane, is characterized in that said feed horn can be fixed in position while its equivalent feed horn, i.e., the image of said feed horn focused by the beam waveguide feeder, can be moved into an arbitrary location and turned in an arbitrary direction.

3 Claims, 11 Drawing Figures

BEAM WAVEGUIDE FEEDER

BACKGROUND OF THE INVENTION

1. Field of the Invention

This invention relates to a beam waveguide feeder for use in an aperture antenna, comprising a feed horn and a plurality of quadric surface reflectors such as revolution paraboloidal reflectors or reflectors very close to the paraboloid.

2. Description of the Prior Art

A prior art beam waveguide feeder was composed of a feed horn 1 and four reflectors 2,3,4 and 5 for example as shown in FIG. 1, in which the reflector 5 has a plane surface and the reflectors 2, 3, 4 and 5 have quadric surfaces, and are arranged in such a way as to cancel the cross polarization components generated thereon.

In an embodiment, the arrangement is a combination of a plane reflector 2 and a pair of paraboloidal reflectors each having the same focal distance and off-set angle.

With reference to FIG. 1, an explanation will be made about operation of this prior art B.W. (beam waveguide) feeder used with a Cassegrain transmission antenna.

An electric wave fed from a transceiver 12 through feed horn 1 is reflected at the four reflectors including plane reflector 2, paraboloidal reflectors 3 and 4, and plane reflector 5, and focuses at a point 8, then it travels to the Cassegrain antenna consisting of a subreflector 6 and a main-reflector 7, from which it is radiated.

The wave transmitted from the B.W. feeder is supplied to the antenna as if it originated from an assumed feed horn 1' with its phase center at the point 8 (hereinafter, this horn is called the equivalent feed horn). In such a B.W. feeder, the Cassegrain antenna 6,7 and the plane reflector 5 are revolvable about the elevation axis 11 in scanning the antenna beam about the elevation axis 11; therefore it is not necessary to move the feed horn 1.

On the other hand, it is possible to scan the antenna beam around the azimuth axis 10 by a revolution of the entire unit consisting of the antenna, plane reflector 2, paraboloidal reflectors 3 and 4 and plane reflector 5 about the azimuth axis 10. With this B.W. feeder, the feed horn 1 can stand still while the equivalent feed horn 1' is moving. This feeder makes it possible to scan the antenna beam with the feed horn 1 connected to a transceiver 12 fixed on the ground.

So far, the explanation has been made of a prior art B.W. feeder employed in a Cassegrain antenna. Next, an explanation will be made of the B.W. feeder utilized in a spherical reflector antenna. As shown in FIG. 2, the spherical reflector antenna consists of a spherical reflector 15 and a feed horn 1, and is characterized in that beam scanning is carried out by a revolution of the feed horn 1 about the center 16 of the spherical reflector 15 instead of moving the spherical reflector 15.

FIG. 3 shows an example in which the prior art B.W. feeder of FIG. 1 is applied to spherical reflector 15. In the drawing, the spherical reflector 15 is used in off-set form so as to avoid blocking of the antenna aperture surface by the B.W. feeder. To correct a factor such as spherical aberration of reflector 15, one or more subreflectors may be provided between the spherical reflector 15 and equivalent feed horn 1'. This is explained in detail in the paper written by the inventor of this application: Watanabe, Mizuguchi "On the Design Method for Reflector Surfaces of an Offset Spherical Reflector Antenna". Paper of Technical Group TGAP 81-29 (1981, 6,25)—Institute of Electro Communication in Japan.

The B.W. feeder comprising a feed horn 1, plane reflector 2, paraboloidal reflectors 3 and 4 and a plane reflector 5 is the same as that of FIG. 1.

By a revolution of plane reflector 5 about axis 11 which passes through the center 16 of spherical reflector 15, the beam radiated from the antenna can be deviated around the axis 11. By a revolution of a structure consisting of plane reflector 2, paraboloidal reflectors 3 and 4 and plane reflector 5 about an axis 10 which passes through the center 16 of spherical reflector 15 and the phase center 9 of the feed horn 1, the beam radiated from the antenna can be deviated about the axis 10.

By use of the above mentioned structure in the manner described, it is not necessary to move the spherical reflector 15 and the feed horn 1 in scanning the antenna radiation beam.

In the prior art apparatus of FIG. 3, the cross point of the two revolution axes 10 and 11 of the B.W. feeder must be at the center 16 of the spherical reflector 15, therefore the apparatus exhibits the following three problems:

(1) In a spherical reflector antenna, the equivalent feed horn 1' is located at a half distance of the radius R of spherical reflector 15. Therefore, the plane reflector 5 placed at the center of spherical reflector 15 must be as large as the reflector 15. Because of this restrictive condition, this type of antenna is impractical.

(2) Since the reflector 15 has a spherical aberration, the effective aperture D of the spherical reflector antenna can not be larger than the radius R of spherical reflector 15. Especially in the case of the off-set type, in practice, the radius R of the reflector 15 should be about twice the effective aperture D of the spherical reflector antenna. Accordingly, the wave transmission distance between the B.W. feeder and the antenna will be very long, thereby reducing transmission efficiency as well as requiring a huge structure.

(3) The spherical reflector antenna is useful if it is used as a multiple beam antenna provided with plural feed horns to give plural beams. The B.W. feeder of FIG. 3, however, can not accomodate plural beam guides to feed a single spherical main reflector, because the plane reflector 5 must be positioned at the center 16 of spherical reflector 15.

These problems arise because the mechanism is such that the equivalent feed horn 1' can not move beyond the revolution around the axes 10 and 11.

For such beam steerable antennas as spherical reflector antennas which can scan the beam with their main reflector fixed, torus antennas and bifocal antennas, each type antenna requires its particular equivalent horn motion. The above mentioned prior art B.W. feeder, however, is incapable of moving the equivalent feed horn to an arbitrary position, nor is it capable of directing it in arbitrary direction, and therefore it is substantially impossible to fix the feed horn.

SUMMARY OF THE INVENTION

It is an object of this invention to remove the deficiency of the prior art B.W. feeder mentioned above, and provide a B.W. feeder that can move the equivalent feed horn to an arbitrary position and direct it in arbitrary direction while the feed horn is fixed.

DETAILED DESCRIPTION OF THE INVENTION

An explanation will now be made of the embodiments of this invention.

Figure 3:
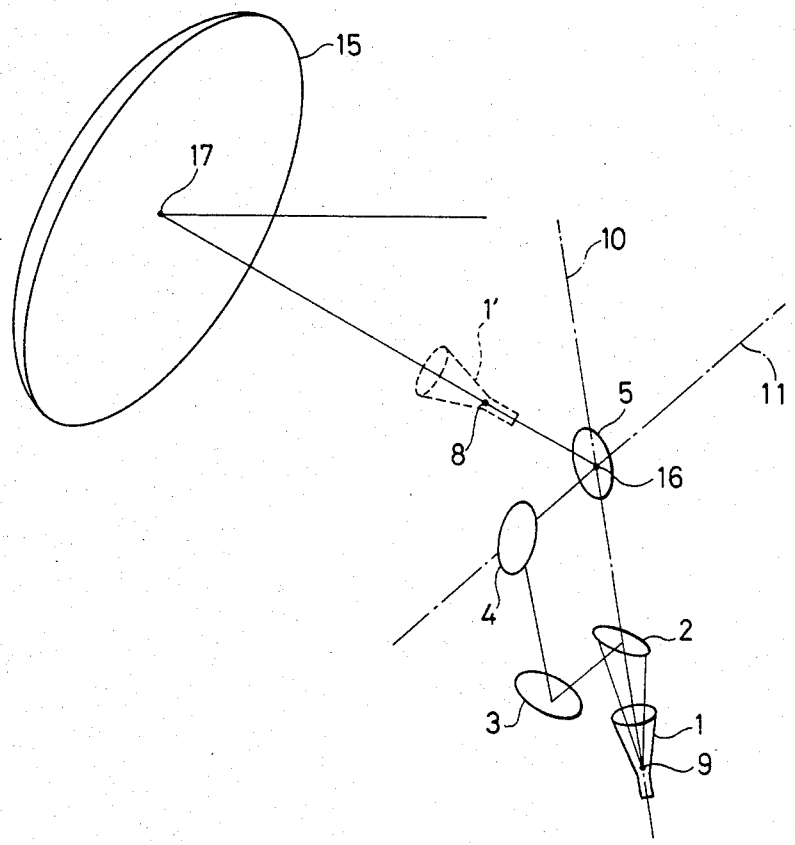
FIG. 3 PRIOR ART
FIG. 3 illustrates a prior art B.W. feeder applied to a spherical reflector antenna.
Figure 4:
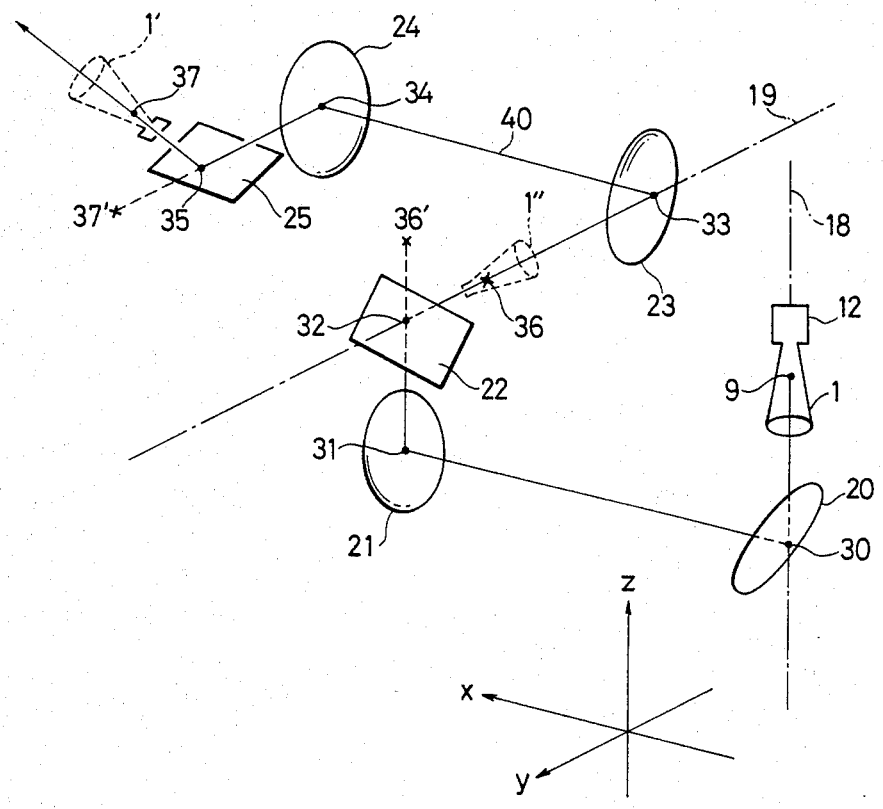
FIG. 4 shows a first embodiment of the B.W. feeder according to this invention.

FIG. 4 shows a first embodiment of the B.W. feeder according to this invention, in which the reference number 1'' denotes a feed horn having its phase center at the focus 36, 18 denotes an axis on which phase center 9 of feed horn 1 and reflection point 30 of the beam center line on the reflector 20 are aligned, and 19 denotes an axis on which reflection points 32 and 33 of the beam center line on reflectors 22 and 23 is aligned. The reference numbers 20, 21, 22, 23, 24 and 25 denote reflectors, the numbers 30, 31, 32, 33, 34 and 35 are reflection points of reflectors 20 through 25 for beam center lines, numbers 36, 36', 37 and 37' denote focuses, and 40 is an axis which connects reflection points of the beam center line of the reflectors 23, 24. Other reference numbers are the same or equivalent to those in FIG. 1 or FIG. 3.

The reflectors 22 and 25 are plane reflectors. The reflectors 20 and 21, having their focuses at points 9 and 36' respectively, are a pair of quadric surface reflectors (e.g., oval surfaces of the same shape or paraboloidal surfaces having identical focal distances and off-set angle) by which the cross polarization waves are canceled. The term "off-set angle" of a reflector, as used herein and in the appended claims, is defined as the angle between the rotation axis of the reflector and a straight line which connects a focus of the reflector to a reflection point of the beam center line. The reflectors 23 and 24, having their focuses at points 36 and 37' respectively, are paraboloidal reflectors that are equal in their focal distance and off-set angle, or quadric surface reflectors (e.g., such as oval reflectors very close to paraboloidal reflector) which transmit the electric wave substantially parallel in consideration to a wave motion effect.

With this construction, the electric wave radiated from the feed horn 1, after being reflected in sequence by reflectors 20 and 21 and the plane reflector 22, focuses at point 36. The electric wave once focused at point 36 is further transmitted and reflected in sequence by reflectors 23 and 24 and the plane reflector 25, and then focuses at point 37. This wave further travels to the antenna as if it is originated from the equivalent feed horn 1'.

The points 9, 30, 31 and 32 are all in the same plane, and the other points 32, 33, 34 and 35 are in another common plane. All of the reflectors 20, 21, plane reflector 22, reflectors 23, 24 and plane reflector 25 are revolvable about a straight line which is defined by the beam center axis of feed horn 1, or the revolution axis 18.

The entire structure including reflectors 23 and 24 and the plane reflector 25 revolves around the axis 19 which passes through points 32 and 33.

The reflector 24 and the plane reflector 25 move in parallel with axis 40 that passes through points 33 and 34. This axis 40 is parallel to a line that passes through focuses 36 and 37' of reflectors 23 and 24. Furthermore, the plane reflector 25 is so constructed that it can be turned in an arbitrary direction with the point 35 fixed.

Generally, such motions as a revolution around axis 18, a revolution around axis 19 and expansion and contraction in the direction of axis 40 are represented by using parameters $\phi$, $\theta$ and $\gamma$ in a polar coordinate system with its zenith of Z axis. Since these three variables are independent of each other, the point 35 can be moved to an arbitrary position.

The equivalent feed horn 1' can turn in an arbitrary direction at an arbitrary position depending upon the position and direction of plane reflector 25.

Figure 2:
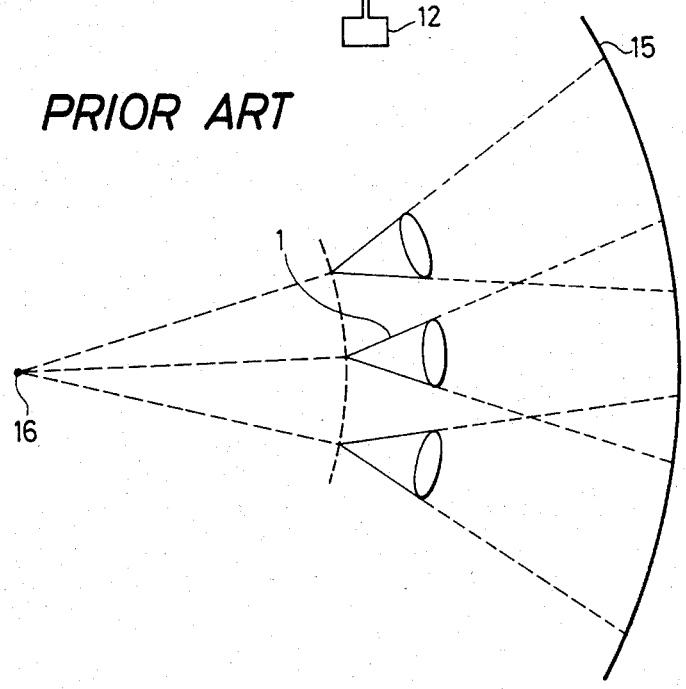
FIG. 2 PRIOR ART
FIG. 2 is a drawing for explaining the movement of a feed horn for a spherical reflector antenna.

Next, an explanation will be made about the effect of this B.W. feeder having a freely movable equivalent feed horn 1' which is used as a feeder of a spherical reflector antenna. In a spherical reflector antenna, as shown in FIG. 2, the feed horn or equivalent feed horn must be moved about the revolution center 16 of spherical reflector 15. In a prior art B.W. feeder of FIG. 3, it is necessary to install the plane reflector 5 at the center 16 of spherical reflector 15.

As stated hereinbefore, the feeder has such defects that its transmission distance is long and plural B.W. feeders for multiple beams can not be installed.

The B.W. feeder of the present invention, however, can overcome said deficiencies of the prior art, because the plane reflector 25 can be located at any position irrespective of the center 16 of spherical reflector 15 as mentioned above (see FIG. 3).

Figure 1:
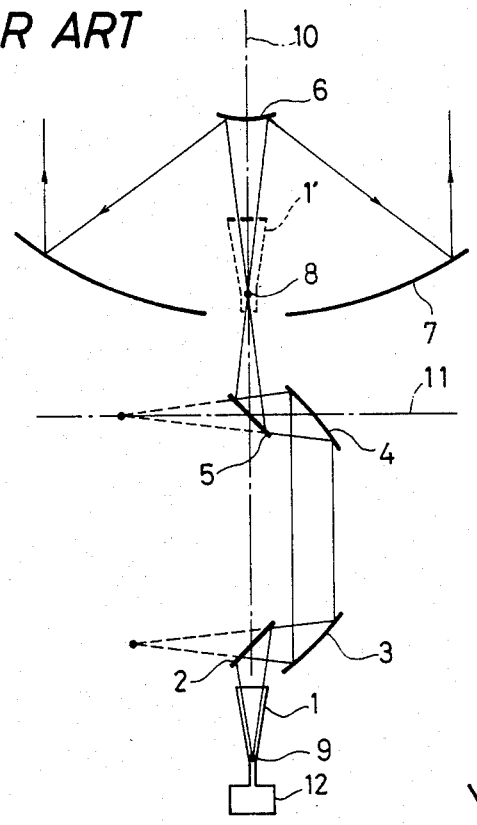
FIG. 1 PRIOR ART
FIG. 1 shows a prior art B.W. feeder applied to a Cassegrain antenna.

The B.W. feeder of FIG. 4, as well as that of FIG. 1, satisfies the canceling condition of the opto-geometrical cross polarization component. This is an embodiment in which the reflector 24 and the plane reflector 25 are moved in parallel with the axis 40. The motion is not confined to the above embodiment, but the entire structure of reflector 21, plane reflector 22, reflectors 23 and 24 and plane reflectors 25 may also be moved in parallel with the axis which passes through points 30 and 31.

Figure 5:
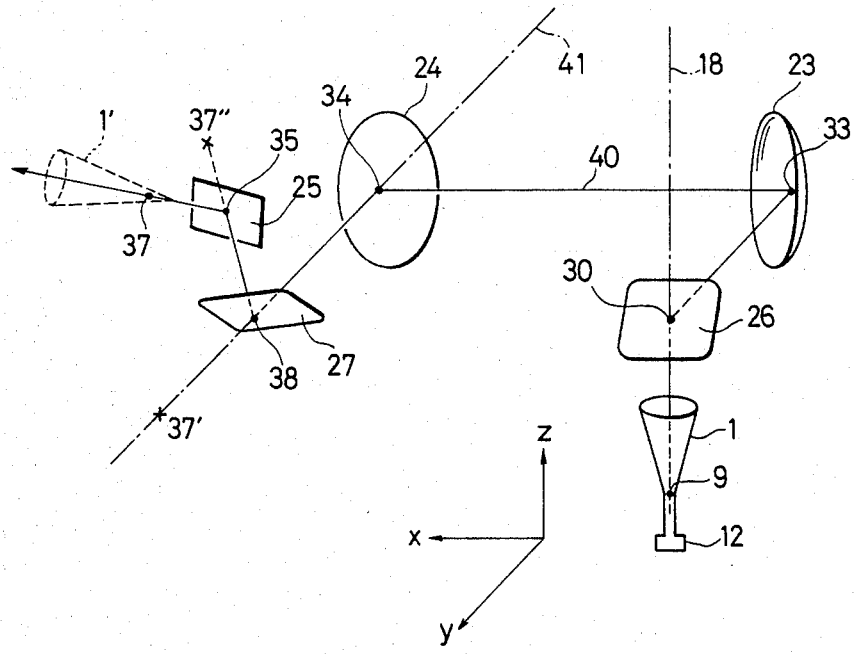
FIG. 5 shows a second embodiment of the B.W. feeder according to this invention.

A second embodiment of the B.W. feeder according to this invention is shown in FIG. 5, in which reference numbers 26 and 27 denote plane reflectors, 30 and 38 denote reflection points of the beam center line at the reflector surfaces of plane reflectors 26, 27 and 41 is an axis which connects reflection points of beam center line of the reflectors 24, 27, and number 37'' is a focus of reflector 24. Other reference numbers denote the same or equivalent parts as those in FIG. 4.

The entire structure consisting of plane reflector 26, reflectors 23 and 24 and plane reflectors 27, 25 is revolvable about the beam center axis 18 of feed horn 1. All of the reflector 24 and plane reflectors 27, 25 move, in the same way as shown in FIG. 4, along the axis 40 with each of the points 30, 33, 34 and 37' kept on the same plane. The plane reflector 27 revolves around the revolution center axis 41, and the plane reflector 25 is, in the same way as shown in FIG. 4, so constructed as to turn in an arbitrary direction with the point 35 unmoved.

With the B.W. feeder having such construction, the electric wave radiated from the phase center 9 of feed horn 1, is changed in direction at the plane reflector 26, is transmitted in such a way as to be focused at point 37' by a pair of paraboloidal reflectors 23 and 24 having identical off-set angle and focal distance. This wave, then, is reflected at the two plane reflectors 27, 25 and focuses at point 37.

Motion of the equivalent feed horn 1' of B.W. feeder having the structure mentioned above will be explained.

Figure 6:
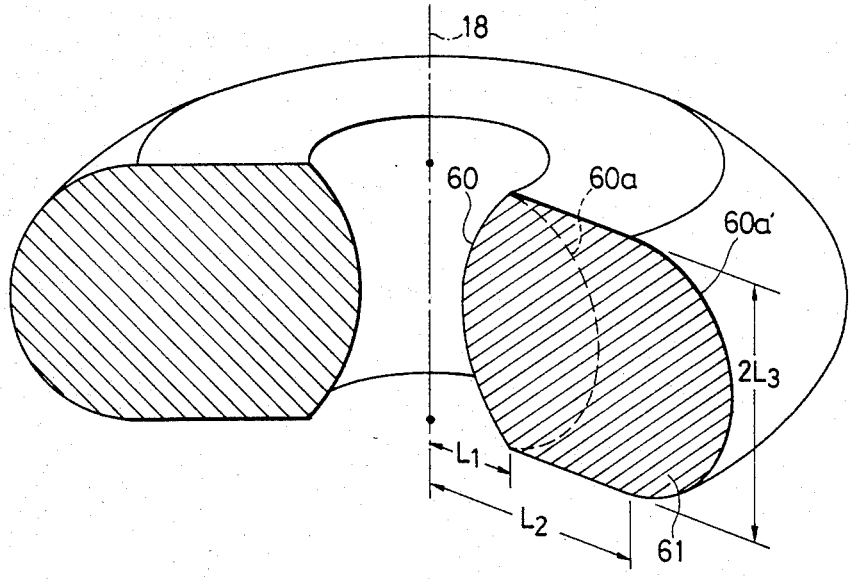
FIG. 6 is a drawing for use in explaining the range of movement of the equivalent feed horn in the B.W. feeder of FIG. 5.

FIG. 6 is a diagram illustrating the range within which the revolution center 35 of the plane reflector 25 can move. Assuming the interval between two points 38 and 35 is L3, the point 35 revolves about axis 41, i.e., moves on arcs 60 and 60*a*.

In proportion to a change of interval between the pair of paraboloidal reflectors 23 and 24 from L1 to L2, the arc orbit 60*a* moves to 60*a'* by a parallel transfer. More particularly, the point 35 can move about within a region 61 that is bounded by the two arcs 60 and 60*a'*. Since the B.W. feeder of FIG. 5 revolves about the revolution axis 18, the region 61 revolves around the revolution center axis 18. The point 35, therefore, can move in the space defined by a doughnut shape as shown in FIG. 6.

Since the plane reflector 25 is so constructed as to be able to turn in an arbitrary direction with point 35 fixed, the equivalent feed horn 1' can turn in an arbitrary direction at an arbitrary position in the space shown in FIG. 6.

The B.W. feeder of this embodiment, in which the equivalent feed horn 1' is free to move in said space, has the same effect as those explained in connection with the first embodiment of FIG. 4. The only difference is the restriction that the movable range of the equivalent feed horn is confined to that of FIG. 6, but the number of reflectors is smaller than that of the B.W. feeders of FIG. 4.

Next, a third embodiment of the B.W. feeder of this invention will be explained with reference to FIG. 7.

In the figure, the reference number 29 denotes a plane reflector, and 39 denotes a reflection point on the surface of plane reflector 29 on which the center beam is reflected. Other numbers and letters show the same or equivalent things to those of FIG. 3 and FIG. 4.

A pair of reflectors 23 and 24, in this embodiment, have paraboloidal surfaces just like those in FIGS. 4 and 5, or quadric surfaces such as ellipsoidal surfaces which are very close to the paraboloid, and are movable in parallel with each other toward and away from one another along axis 40.

In comparison with the plane reflectors of FIGS. 4 and 5 which can turn in any direction with point 35 fixed, the plane reflector 29 of the present embodiment can not only turn in an arbitrary direction with the point 39 fixed, but also moves in parallel along axis 42. In addition, the entire structure of the reflectors 23 and 24 and plane reflector 29 is revolvable about the beam axis 18 of the feed horn 1.

Next the motion of the equivalent feed horn 1' of the B.W. feeder having the above stated structure will be explained. In the explanation, a coordinate axis system is adopted which has an origin representing the phase center 9 of feed horn 1 and a z-axis representing beam center axis 18. The distance between the points 33 and 34 is given by $t_1$, and the interval between the points 37 and 39 by $t_2$. Moreover, the extent of revolution of reflectors 23 and 24 about z-axis 18 is given by $\phi_1$.

Let's define a unit vector $\vec{P}$ of equivalent feed horn 1' in the beam axis direction by $$\vec{P} = \begin{vmatrix} Px \\ Py \\ Pz \end{vmatrix} \tag{1}$$

The phase center 37 of equivalent feed horn 1', then, can be represented by the following equation, using $t_1$, $t_2$, $\phi_1$ and P.

$$\begin{bmatrix} t_1 \cos \phi_1 + t_2 Px \\ t_1 \sin \phi_1 + t_2 Py \\ \qquad + t_2 (Pz + 1) \end{bmatrix} \tag{2}$$

The equation (2) shows that the equivalent feed horn 1' can turn in any direction within the range specified by $t_1$, $t_2$ and $\phi_1$.

The detailed description will be made in connection with the B.W. feeder of FIG. 7 applied to an off-set spherical reflector antenna.

As already stated, in a spherical reflector antenna, it is necessary for the equivalent feed horn 1' to move about a revolution center given by the center 16 of the spherical reflector. In FIG. 7, the coordinate system X-Y-Z has its origin at the center 16 of the spherical reflector, and Z-axis is assumed to be parallel to z-axis for simplicity. The revolution radius of equivalent feed horn 1' is $r_0$, and its revolution angles are $\eta$, $\xi$ as shown in FIG. 8. At the reference position where $\eta=\xi=0$, it is assumed that the phase center 37 of equivalent feed horn 1' is away from x-axis with angle $\beta_0$ and its direction $\beta_2$. (Counterclockwise revolution is defined as a positive angle).

If the equivalent feed horn 1' moves by angles $\eta$, $\xi$, the position vector $\overrightarrow{OF_2}$ of point 37 and unit direction vector $\vec{P}$ of equivalent feed horn are respectively represented by $$\overrightarrow{OF_2}(\eta, \xi) = r_0 \begin{vmatrix} \cos(\beta_0 + \xi) \cos \eta \\ \cos(\beta_0 + \xi) \sin \eta \\ -\sin(\beta_0 + \xi) \end{vmatrix} \tag{3}$$

$$\vec{P}(\eta, \xi) = \begin{vmatrix} \cos(\beta_2 + \xi) \cos \eta \\ \cos(\beta_2 + \xi) \sin \eta \\ -\sin(\beta_2 + \xi) \end{vmatrix} \tag{4}$$

In this B.W. feeder, as stated above, $t_1$, $t_2$, $\phi_1$ and the direction of plane reflector 29 are varied in order to move the equivalent feed horn 1'.

According to equations (2), (3) and (4), parameters $t_1$, $t_2$, $\phi_1$ must satisfy the relation of the following equation:

$$r_0 \begin{vmatrix} \cos(\beta_0+\xi)\cos\eta \\ \cos(\beta_0+\xi)\sin\eta \\ -\sin(\beta_0+\xi) \end{vmatrix} = \begin{vmatrix} Xc \\ 0 \\ Zc \end{vmatrix} + t_1 \begin{vmatrix} \cos\phi_1 \\ \sin\phi_1 \\ 0 \end{vmatrix} + t_2 \begin{vmatrix} \cos(\beta_2+\xi)\cos\eta \\ \cos(\beta_2+\xi)\sin\eta \\ -\sin(\beta_2+\xi)+1 \end{vmatrix} \quad (5)$$

where, Xc and Zc are coordinate values of the phase center of fixed feed horn 1.

Solving equation (5) in relation to $t_1$, $t_2$ and $\phi_1$, equations (6), (7) and (8) are obtained:

$$t_1^2(\eta,\xi) = Xc^2 + D^2(\xi) - 2XcD(\xi)\cos\eta \quad (6)$$

$$t_2(\xi) = \frac{-r_0\sin(\beta_0+\xi) - Zc}{1-\sin(\beta_2+\xi)} \quad (7)$$

$$\tan\phi_1(\eta,\xi) = \frac{\sin\eta}{\cos\eta - \frac{xc}{D(\xi)}} \quad (8)$$

where, $$D(\xi) = \frac{r_0\cos(\beta_0+\xi) + r_0\sin(\beta_0+\beta_2) + Zc\cos(\beta_2+\xi)}{1-\sin(\beta_2+\xi)} \quad (9)$$

Figure 7:
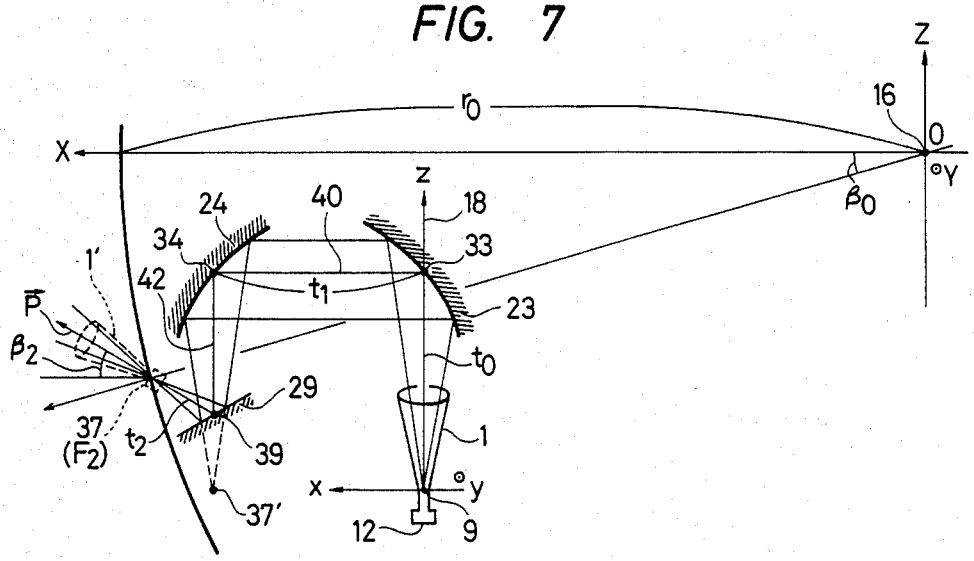
FIG. 7 shows a third embodiment of the B.W. feeder according to this invention.
Figure 8:
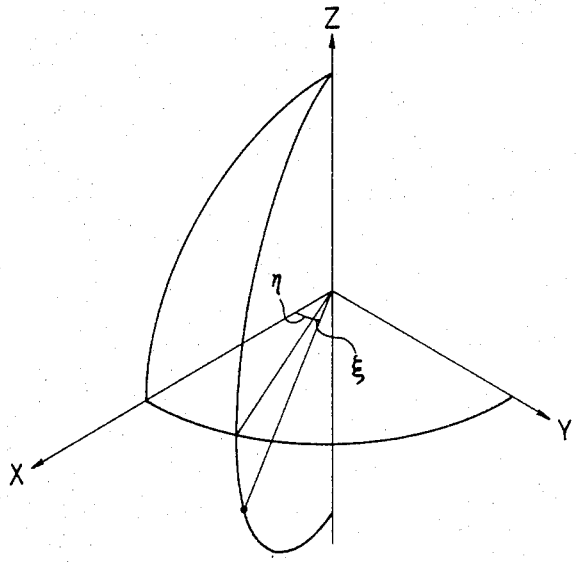
FIG. 8 shows coordinate axes used in explaining movement of the equivalent feed horn of FIG. 7.

The direction of plane reflector 29 is determined by equation (4). The extent of revolution of plane reflector 29 about axis 42 is $\phi_2$, and the extent of revolution around the axis on plane reflector 29 and perpendicular to axis 42 is $\phi_3$. The normal vector $\vec{n}$ of plane reflector 29 and vector $\vec{P}$ satisfy the following relation because of the reflection law:

$$\vec{n} = \frac{\vec{P}+\vec{K}}{|\vec{P}+\vec{K}|} \quad (10)$$

where, $\vec{K}$ stands for a unit vector in the Z-axis direction of FIG. 7.

The vector $\vec{n}$ represented with $\phi_2$, $\phi_3$ is $$\vec{n}(\phi_2,\phi_3) = \frac{1}{\sqrt{2-2\sin\beta_2}} \begin{bmatrix} \{\sin\phi_3 + \cos(\beta_2+\phi_3)\}\cos\phi_2 \\ \{\sin\phi_3 + \cos(\beta_2+\phi_3)\}\sin\phi_2 \\ \cos\phi_3 - \sin(\beta_2+\phi_3) \end{bmatrix} \quad (10)'$$

Substituting equations (4) and (10)' for equation (10), and solving with respect to $\phi_2$ and $\phi_3$, the relations (11) (12) below are obtained:

$$\phi_2 = \eta \quad (11)$$

$$\phi_3 = \frac{\xi}{2} \quad (12)$$

By moving each reflector of the B.W. feeder of FIG. 7 according to equations (6), (7), (8), (11) and (12), the feed horn of the spherical antenna can be fixed at an arbitrary position irrespective of the center of the feed horn.

The B.W. feeder having the construction of FIG. 7 has a narrow range of equivalent feed horn movement, though the number of reflectors is smaller than those of FIGS. 4 and 5. With reference to motion of the reflectors shown by equations (6), (7) and (8), the range in which said equivalent feed horn can move will now be explained.

Figure 9:
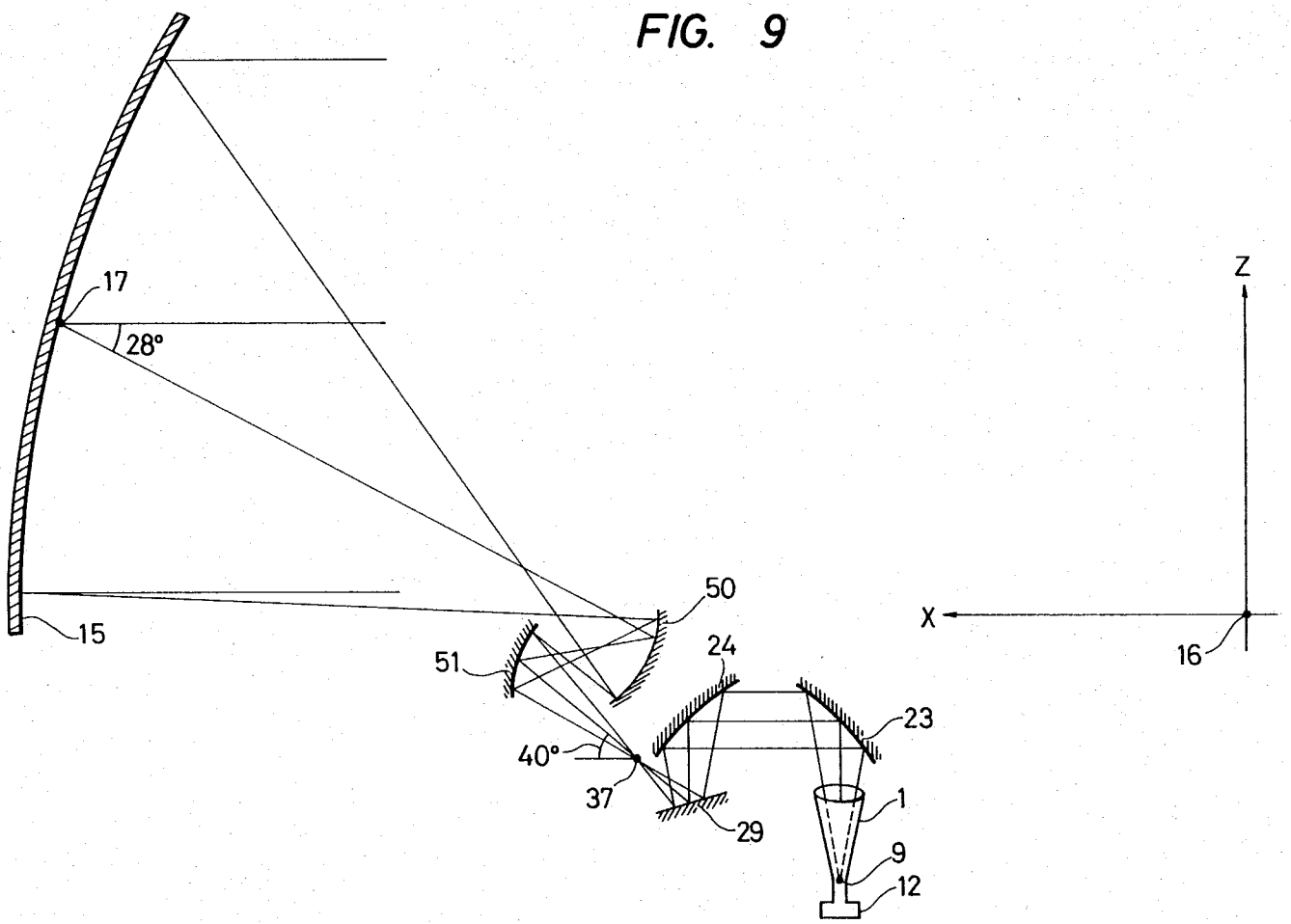
FIG. 9 is a cross sectional view of an off-set spherical reflector antenna having two sub-reflectors, to which the B.W. feeder of FIG. 7 is applied.

FIG. 9 is a cross sectional view of an off-set spherical reflector antenna provided with two subreflectors 50, 51 to which the B.W. feeder of FIG. 7 is applied. The off-set spherical reflector antenna is shown in said paper, i.e., Watanabe, Mizuguchi "On the Design Method for Reflector Surfaces of an Offset Spherical Reflector Antenna" Institute of Electro Communication Paper of Technical Group TGAP 81-29 (1981, 6, 25).

It is assumed that the origin is at the center 16 of spherical reflector 15, the distance between point 17 and Z-axis is 1, and the radius of the spherical reflector is 1.031.

The parameter $\beta_0$ is 13.1°, $\beta_2$ is 40°, the focal distance of paraboloidal reflectors 23 and 24 is 0.065 for the distance 1 between said point 17 and Z-axis, parameters $t_1$ and $t_2$ are 0.13 and 0.06 for said distance 1 where $\eta$ and $\xi$ are zero, and the coordinate values of point 9 are Xc=0.343 and Zc=−0.219.

In the antenna of FIG. 9, the parameters $t_1$, $t_2$ and $\phi_1$ vary in the range given by equations (6), (7) and (8), for example, assuming that the antenna beam is scanned by 15° ($-7.5° \leqq \eta \leqq 7.5°$) around Z-axis and by 3° ($-1.5° \leqq \xi \leqq 1.5°$) in the plane including the Z-axis:

$$0.128 \leqq t_1 \leqq 0.142 \quad (13)$$

$$0.052 \leqq t_2 \leqq 0.067$$

$$-26.3° \leqq \phi_1 \leqq 26.3°$$

In this case, the variation of transmission distance between the two reflectors 23 and 24 is about ±5%. As $t_2$ is independent of $\eta$, in relation to the antenna beam scanning in $\eta$ direction, the plane reflector 29 requires nothing more than being moved in a body with subreflectors 50 and 51.

Figure 10:
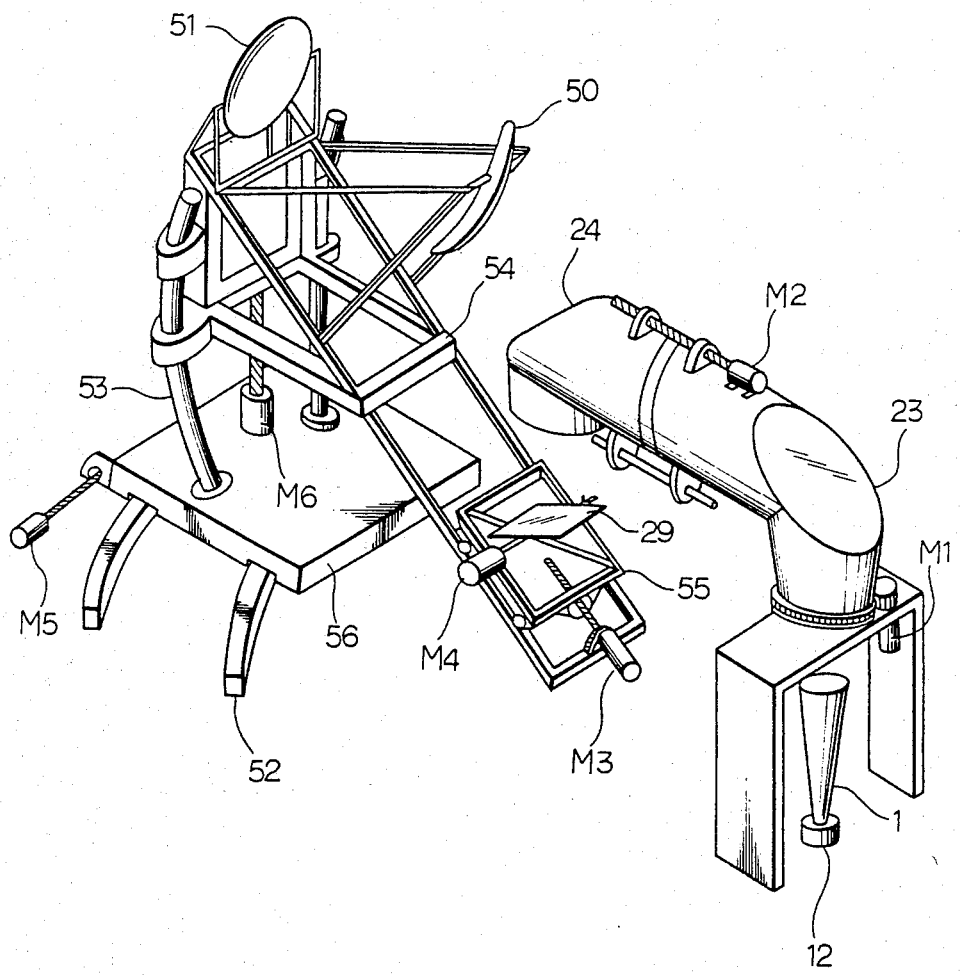
FIG. 10 is a perspective view of the feeder of the antenna of FIG. 9.

A perspective view of the B.W. feeder according to the embodiment of FIG. 9 is shown in FIG. 10, in which reference numbers 52 and 53 denotes rails, 54, 55 and 56 denote supports and M1–M6 denote motors. Other numbers and letters are the same as those of FIGS. 7 and 9.

The motors M1–M6 are used for driving respective movable parts; the actual motions are as follows: The motor M1 causes the two reflectors 23 and 24 to revolve (corresponding to $\phi_1$ of each equation). The motor M2 causes the reflector 24 to move in parallel with reflector 23 (corresponding to $t_1$ of each equation). The two subreflectors 50 and 51 are fixed at support 54. The plane reflector 29 together with support 55 is driven by motor M3 to move in parallel with subreflector 51 on support 54 (corresponding to $t_2$ in each equation), and is driven by motor M4 to revolve (corresponding to $\phi_3$ in each equation).

The support 54 on which plane reflector 29 and subreflectors 50 and 51 are mounted is driven by motor M6 to move along rail 53 (corresponding to $\xi$ of each equation). Furthermore, support 56 is driven by motor M5 to move along rail 52 (corresponding to $\eta$ of each equation). Rails 52 and 53 are shaped in arcs whose revolution centers are Z-axis and Y-axis, respectively.

Motors M1, M2, M3 and M4 synchronize with motors M5 and M6 for scanning the antenna beam, and are controlled in accordance with equations (8), (6), (7) and (12), respectively.

The feeder of FIG. 10 has no drive motor corresponding to the revolution quantity $\phi_2$ about axis 42 of plane reflector 29. The reason is that the movement is substantially realized by the movement of the plane reflector 29 by motor M5 together with support 54 along with the rail 52 because $\phi_2$ is equal to $\eta$ as represented by equation (11).

Figure 11:
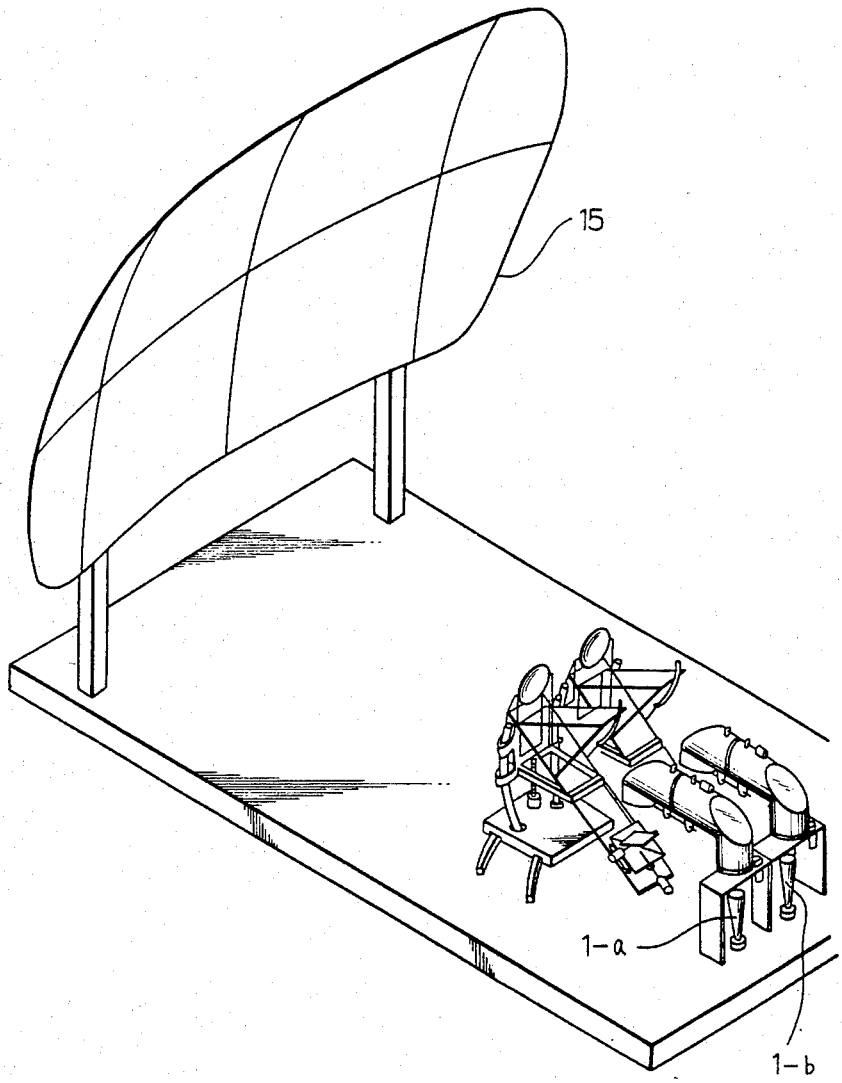
FIG. 11 is a perspective view of said off-set spherical reflector antenna to which two B.W. feeders of FIG. 7 are applied.

FIG. 11 is a perspective view of the off-set spherical reflector antenna to which two B.W. feeders according to FIG. 10 are applied. As shown in FIG. 2, in the spherical reflector antenna a beam scanning is achieved by a revolutional movement of the feed horn about the revolution center defined by the center of the sphere. Therefore a multiple beam antenna can be realized by using plural feed horns. In the antenna provided with a prior art B.W. feeder, as shown in FIG. 3, the plane reflector 5 must be located at the center 16 of the spherical reflector as described hereinbefore; therefore it is impossible to provide plural B.W. feeders for multiple beams.

In the B.W. feeders of this invention, on the other hand, the position of the plane reflector is determined irrespective of the center of the spherical reflector, so that a multiple beam antenna can be realized in the manner shown in FIG. 11.

In the arrangement of FIG. 11, the electric waves radiated from two feed horns 1-*a* and 1-*b* are transmitted by independent B.W. feeders of the type shown in FIG. 10, being reflected at spherical main reflectors 15, and form respective antenna radiation beams. In this antenna, two B.W. feeders of the present invention are utilized, so that the two antenna radiation beams are independently turned in their own directions, with the main reflector and feed horn fixed. It goes without saying that more than two B.W. feeders of this invention may be utilized.

As described above, the B.W. feeder of this invention permits the feed horn to remain fixed in position while its equivalent feed horn, which is an image of the feed horn transcribed by the B.W. feeder but which functions as a feed horn in practical effect, can be positioned at any place and turned in any direction. This B.W. feeder, therefore, has the advantage of being able to locate the feed horn at an arbitrary position with respect to the antenna.

Generally, in a beam steerable antenna such as a spherical reflector antenna in which the beam scanning operation is executed with a fixed main reflector, a torus antenna and a bifocal antenna, each antenna requires its own movement of respective equivalent feed horn as stated in connection with the prior art technology.

As the B.W. feeder of this invention makes it possible to bring the equivalent feed horn to an arbitrary position as mentioned above, it can be used as the feeder of these antenna systems. In a large scale earth station antenna for satellite communications utilizing a beam deviation antenna equipped with a B.W. feeder of this invention, all of the main-reflector, feeder horn, transceiver, etc. can be installed on the ground; therefore this feeder has the advantages that it withstands wind well and that maintenance is easy.

Furthermore, since the feeder of this invention can be installed at an arbitrary position with respect to the antenna, installation of plural feeders of this invention in a beam steerable antenna results in a formation of multibeam steerable antenna with fixed feed horns.

What is claimed is:

1. A beam waveguide feeder comprising a feed horn, a pair of revolution quadric surface reflectors facing each other, said quadric surface reflectors being identical in focal distance and off-set angle and having their focuses and the reflection points of center beams on the same plane, and at least one plane reflector, said reflectors being arranged relative to said feed horn to form a continuous electric wave path in sequence from said feed horn to one and then the other of said pair of quadric surface reflectors, and then from said other of said quadric surface reflectors to said plane reflector; said feeder further comprising means for moving said quadric reflectors toward and away from one another parallel to a line that passes through the focuses of said revolution quadric surface reflectors, means for turning said plane reflector in an arbitrary direction at an arbitrary position, and means for turning said pair of revolution quadric surface reflectors and said plane reflector as a unit around a revolution axis that is defined by the beam center axis of said feed horn.

2. A beam waveguide feeder comprising a feed horn, a pair of revolution quadric surface reflectors facing each other, said quadric surface reflectors being identical in focal distance and off-set angle and having their focuses and the reflection points of center beams on the same plane, and two plane reflectors, said reflectors being arranged relative to said feed horn to form a continuous electric wave path in sequence from said feed horn to one and then the other of said pair of quadric surface reflectors, and then from said other of said quadric surface reflectors to one and then the other of said two plane reflectors; said feeder further comprising means for moving said quadric reflectors toward and away from one another parallel to a line that passes through the focuses of said revolution quadric surface reflectors, means for turning said other of said two plane reflectors in an arbitrary direction, means for turning said one of said plane reflectors around a revolution axis defined by the beam center line extending from said other revolution quadric surface reflector to said one plane reflector, and means for turning said pair of revolution quadric surface reflectors and said two plane reflectors as a unit around a revolution axis that is defined by the beam center axis of said feed horn.

3. A beam waveguide feeder comprising a feed horn, a first pair of revolution quadric surface reflectors facing each other, said first quadric surface reflectors respectively being identical in focal distance and off-set angle and having their focuses and the reflection points of center beams in a common first plane, a first plane reflector, a second pair of revolution quadric surface reflectors facing each other, said second quadric surface reflectors respectively being identical in focal distance and off-set angle and having their focuses and the reflection points of center beams in a common second plane which intersects said common first plane, and at least one second plane reflector, said reflectors being arranged relative to said feed horn to form a continuous electric wave path in sequence from said feed horn to one and then the other of said first pair of quadric surface reflectors, and then to said first plane reflector, and then from one to the other of said second pair of quadric surface reflectors, and then to said second plane reflector, said first plane reflector being so located that its reflection point in said continuous electric wave path is located on the line of intersection between said common first plane and said common second plane, and said second plane reflector being so located that its reflection point in said continuous electric wave path is located in said common second plane; said feeder further comprising means for turning said second pair of quadric surface reflectors and said second plane reflector as a unit around a revolution axis defined by the beam center line extending from said first plane reflector to said one of said second pair of quadric reflectors, means for moving at least one of said pairs of revolution quadric surface reflectors in parallel with a straight line connecting the focuses of the said pair of revolution quadric surface reflectors, means for turning said second plane reflector in an arbitrary direction, and means for turning all of said revolution quadric surface reflectors and plane reflectors as a unit around a revolution axis defined by the beam center axis of said feed horn.

* * * * *